US006740826B1

(12) United States Patent
Friedrich et al.

(10) Patent No.: US 6,740,826 B1
(45) Date of Patent: May 25, 2004

(54) SAFETY CONTACT STRIP

(75) Inventors: Helmut Friedrich, Lippstadt (DE); Paul Meyer, Büren (DE)

(73) Assignee: ASO GmbH Antriebs-und Stenerungstechnik, Salzkotten (DE)

( * ) Notice: Subject to any disclaimer, the term of this patent is extended or adjusted under 35 U.S.C. 154(b) by 0 days.

(21) Appl. No.: 10/149,836

(22) PCT Filed: Nov. 24, 2000

(86) PCT No.: PCT/DE00/04182

§ 371 (c)(1),
(2), (4) Date: Aug. 15, 2002

(87) PCT Pub. No.: WO01/44611

PCT Pub. Date: Jun. 21, 2001

(30) Foreign Application Priority Data

Dec. 16, 1999 (DE) ..... 299 21 958 U

(51) Int. Cl.[7] ..... H01H 3/16
(52) U.S. Cl. ..... 200/61.43; 200/61.81
(58) Field of Search ..... 200/61.43, 61.81, 200/61.82; 49/26–28

(56) References Cited

U.S. PATENT DOCUMENTS 4,115,952 A * 9/1978 French ..... 49/26
5,384,982 A * 1/1995 Galperin ..... 200/61.43 X
5,481,076 A 1/1996 Mullet et al. ..... 200/61.43
5,780,793 A 7/1998 Buchholz et al. ..... 200/61.44
5,832,665 A 11/1998 Miller et al. ..... 49/27

FOREIGN PATENT DOCUMENTS

DE 37 15 871 11/1988 ..... H01H/13/70
DE 93 06 553 10/1993 ..... H01H/13/16

* cited by examiner

*Primary Examiner*—Renee Luebke
(74) *Attorney, Agent, or Firm*—Cohen, Pontani, Lieberman & Pavane

(57) ABSTRACT

The invention relates to a safety contact strip (1) that is regularly used as a closing edge safely device in squeeze and shear areas, for example, gates, machines or the like, having at least two conductive switch layers (2,3) in a non-conductive closed switching chamber (4) located inside a profile (6) that forms an outer jacket (5). In order to enhance quality while preserving a relatively simple structure of said strip, the profile (6), the switching chamber (4) and the switch layers (2,3) are configured as a single piece having at least one built-in conductor (7,8). In order to ensure safe switching even in case of low switch loads and unexpected direction, the switching chamber (4) is kept free in a cross section by spoke-shaped webs (9,10,11). The invention also provides for a cap for closing the front side of the safety contact strip.

15 Claims, 6 Drawing Sheets

SAFETY CONTACT STRIP

PRIORITY CLAIM

This is a U.S. national stage of application No. PCT/DE00/04182, filed on Nov. 24, 2000. Priority is claimed on that application and on the following application: Country: Germany, Application No.: 29921 958.5, Filed: Dec. 16, 1999.

BACKGROUND OF THE INVENTION

1. Field of the Invention

2. Description of the Related Art

The invention relates to a safety contact strip having at least two conducting switching layers in a non-conducting, closed switching chamber within a profile forming an outer jacket.

Safety contact strips are often used as closing edge safety devices at pinching and shearing points. Fitted on gates, machines and handling equipment, persons and material are protected by such safety contact strips. For this purpose, the known safety contact strips are usually held on a respective fastening side in an aluminum carrier profile.

A safety contact strip of the generic type has a contact-maker profile which is held in a carrier profile and in which a separately formed safety contact strip is accommodated in a switching chamber within the outer jacket of the profile. The special shaping of the contact-maker profiles, consisting in particular of an EPDM or an NBR rubber, protects the safety contact strip lying in the switching chamber from damage and permits not only switching loads for switching the contact-maker profile that are perpendicular to the oppositely lying switching layers of the contact-maker profile.

The advantage of the separate formation of a safety contact strip is firstly to be seen in that it can be accommodated in extremely different contact-maker profiles, in which only the switching chamber is to be formed in cross section in a way corresponding to the safety contact strip. Further advantages are offered by the choice of material components with regard to a highly insulating outer jacket of EPDM with two conductive switching layers lying opposite each other on the inside. These switching layers may also consist of an EPDM material, which is often a comparatively poor electrical conductor. Therefore, metallic conductors, for example stranded copper wires or special metal meshes, which bond well in the conducting layers, are often used in these conducting layers to reduce the ohmic resistance.

DE G 93 08 344.0, DE 94 22 030 U1, DE 93 21 338 U1 or EP 0 654 575 disclose safety contact strips of another type, in which a profile is provided with a single hollow chamber, which has on the inside at least two switching layers lying opposite each other. Although in the case of safety contact strips of this type only a low switching load is necessary, there is the great risk of soiling of the switching layers, for example in the event of breakage of the profile. Since these safety contact strips can be produced from a conductive material and a non-conducting EPDM material, which materials can also be coextruded to form these safety contact strips, there is the great risk of the comparatively thin, outer protective layer of the non-conducting EPDM material not being correctly formed and the conductive layer remaining outwardly uninsulated and easily liable to damage.

SUMMARY OF THE INVENTION

Against this technical background, the invention has the object of providing a safety contact strip of the type in question of high quality, but at the same time of comparatively simple construction, which switches reliably, in particular even under low switching loads, not only from the direction which is actually to be expected.

According to the invention, the profile, the switching chamber and the switching areas, each with at least one embedded conductor, are formed in one piece. As compared with a two-part formation, with a contact-maker profile and a pushed-in safety contact strip, a one-piece formation is advantageous from technical production-related aspects. In particular, the measures of the one-piece formation also allow the thickness of the walls of the switching chamber to be kept relatively small, without there being the risk of soiling in the event of breakage of the outer jacket. The measure of a thinner wall of the switching chamber also significantly improves the response of the safety contact strip under a switching load. In particular, the omission of a separately formed enclosure of the switching layers produces a significant saving of material.

Alternatively and in particular in combination with the aforementioned features, a better switching performance can also be achieved by an embodiment wherein the switching chamber is kept free in a cross section by webs formed in the manner of spokes. At least two webs, preferably three or four webs, of a material thickness which are often within the range of the wall thickness of the profile in the region of the loads to be expected, hold the switching chamber, the wall of which is made much thinner. In this way, a reliable application of force under a switching load of the outer jacket on the switching layers within the switching chamber is ensured. In particular, this measure permits force to be introduced not only in a preferred direction but additionally also from directions which are significantly inclined onto the switching areas of the switching layers.

In this respect, consideration has been given to the fact that an outer jacket of a profile, webs within a profile and a switching chamber form a plurality of chambers that are separate from one another within the profile.

In a particularly advantageous way, it may be provided that the safety contact strip according to the invention is a coextrudate. This produces a simple, one-piece formation of this safety contact strip, which additionally ensures a reliable function. Obtained as a coextrudate of one or more of the preferred materials, silicon, EPDM, NBR, PVC, TPE and further known, expediently elastic, at the same time resistant materials, is a safety contact strip that is formed in one piece and can be optimally adapted to specified mechanical and electrical requirements by the selection of the materials used. In particular in the case of such a coextrudate, it is preferred that the profile is formed from a TPE, that the switching layers are formed from a conducting EPDM and that the conductors are formed from a metal. Consequently, significantly different materials are used here, to be specific non-conducting, thermoplastic elastomers and ethylene/propylene-diene terpolymers and also incorporated metal conductors, for example copper wires, stranded copper wires, metal meshes or the like, whereby much improved switching characteristics can also be achieved. In particular, the outer jacket of the profile of TPE can be adapted comparatively easily to the degree of switching load. TPE is also much more resistant than many chemical compounds such as are also used, for example, in the automotive industry, where safety contact strips of this type are used for example in the case of electric window lifting mechanisms. It is also possible to form the conducting EPDM switching layers specifically with regard to their ohmic resistance, without having to make allowance for an outer, non-conducting EPDM enclosure.

Alternatively and nevertheless expediently against the background of disposal, the profile and the switching layers may consist of a single-grade plastic and the conductors may consist of a metal. For this purpose, the plastics presented above can be used. In this case, only the electrical conductivity of a plastics material has to be differently set, although this has no bearing on joint disposal. The metal may in this case be disposed of in a way known per se or by means of magnetic separators.

If the material, for example a TPE, of the profile has a Shore hardness of 50 to 70, in particular of 60, this produces a balance between a force of resistance against a switching load and a necessary softness for elastic deformation, the elastic deformation having the effect of exerting a pressure via the webs on the switching chamber, by which the switching layers come for example into touching electrical contact.

In particular, if it is used as the material for the outer jacket of the profile, the TPE material, as a non-conductor, should also have an electrical resistance of over 30 MΩ.

In a preferred embodiment of the safety contact strip according to the invention, a sealing lip attached to the profile is provided. The sealing lip may consist of a separate material or of the material of the jacket of the contact strip. A material which is, as far as possible, smooth on the surface and permanently elastic, to allow it to retain its elasticity for example when water penetrates into pores of the material and when there is frost, has proven to be expedient as a material for this. Such a sealing lip may be molded-on, but it is preferred that the complete safety contact strip with the attached sealing lip is produced as a coextrudate, whereby different materials are processed together. These are the non-conducting profile jacket, the resistance of which is to be greater than 30 MΩ, the conducting switching layers, which are to be formed to be as highly conductive as possible, with an embedded metallic conductor, which may in particular also be formed in the manner of a woven fabric, for particularly good bonding in the material, and also the material for the sealing lip of such a material which for example prevents freezing attachment or has good sliding properties, according to requirements.

If, however, the disposal consideration is uppermost, a safety contact strip with an attached sealing lip may alternatively also be produced from a single-grade plastic.

In a way corresponding to an attached sealing lip of a separate material, the jacket of the profile may be formed at least in certain portions such that it has a separate surface coating and/or the jacket of the profile may consist at least in certain portions of an elastic material, in particular with a smooth surface. Here, too, production as a coextrudate is again envisaged, to also ensure good bonding of the materials to one another. By these measures, the surface property of the jacket of the profile can be set to the necessary requirements, for example with regard to good sliding properties, surface smoothness of the profile and so on.

In a further refinement of the invention, it may be provided that, in a cross section, the safety contact strip is symmetrical in relation to a longitudinal center plane. This longitudinal center plane will then also form the plane of symmetry for the switching load, since the application often requires reliable switching under a switching load at an included angle of about 90°.

Alternatively, other forms of profile, which satisfy special requirements under specified loads, are entirely possible.

The safety contact strip according to the invention may have a substantially rectangular cross section with rounded longitudinal edges on the side on which the switching load is expected. However, a profile of which the outer jacket has a parabolic cross section, the apex point of the parabola being arranged lying opposite the fastening side, has proven to be much more advantageous.

In the case of a profile that is particularly of such a parabolic form, in a refinement of the invention it is preferred for the sealing lip to be tangentially attached. Projecting edges are avoided as a result, and the introduction of force from the sealing lip into the profile is usually favorable. This avoids the sealing lip being easily tom or even torn off, for example in the event of freezing attachment or jamming. It has also proven to be expedient, in particular in the case of scaling lips which are attached at less curved portions of the jacket profile, for the free end of the sealing lips to be provided in a cross section with a bend. On the basis of this measure it is possible to form a sealing lip of which the free end covers for example the apex point of the parabolic profile. Alternatively, the sealing lip may also be given a bend toward the outside, if appropriate protruding beyond the profile.

In particular in the case of such a parabolic cross section of the jacket, it has also proven to be expedient that, opposite the fastening side of the profile, two webs formed in a V-shaped manner hold the switching chamber, the angle bisector of the. V-shaped opening of the two webs lying in particular in the plane of symmetry of the profile. Every switching load which occurs on the profile within the V-shaped opening will reliably lead to activation of the safety contact strip according to the invention, and so too will those switching loads which occur significantly outside this V-shaped opening.

The reliability of the activation of the safety contact strip according to the invention under directionally independent switching loads is further enhanced by the measure that, on the fastening side of the profile, at least one web holds the switching chamber, at a distance from a base of the profile. If a central web is provided, this measure allows the switching chamber to tilt freely within the profile and adjust itself in such a way that a relatively small elastic deformation of the profile, even one from the side, leads to reliable activation of the switching contact.

Alternatively, two webs, if appropriate more than two webs, may also be provided for this purpose, consideration then also being given to a symmetrical arrangement of the same. These webs also preferably have a material thickness approximately the same as that of the other webs.

According to a further feature of the invention, the jacket is provided with longitudinally running grooves, in particular on the inner side. These grooves specifically weaken the material strength of the jacket wall, so that a buckling-in, folding-in as it were, of the profile can occur in such regions, or at least easier elastic deformation of the jacket. These measures also make further allowance for a reliable switching performance and, at the same time, such longitudinal grooves may be useful for the extrusion operation.

Comparably to previous arrangements, it may be provided that the switching chamber has an elliptical cross section, the longitudinal axis of the cross section of the switching chamber in particular being perpendicular to the plane of symmetry of the profile. The conducting switching layers are then arranged above and below this longitudinal axis.

It may be expedient in the case of these conducting switching layers if they have surfaces of a concave form. This reduces in a cross section the distance of these conducting layers from the outer edges, which means a smaller switching path.

If a switching chamber of elliptical cross section is provided, a concave-convex cross section is then expediently to be provided for the conducting layers.

Critical regions of safety contact strips quite generally are the points at which the conducting layers are provided with connecting cables. Separate contacting is preferred, since safety contact strips can then be provided in the form of endless profiles.

Alternatively, the embedded metallic conductors may for example also undertake the function of connecting cables, if these conductors are correspondingly led out during production. It can be regarded as disadvantageous in this respect that only made-up safety contact strips of a specific length are then available.

If separate contacting is provided, this often takes place on the end face of the safety contact strip. In this region, reliable operability of the contact strip is often no longer obtained, since a deformation of the switching chamber often cannot take place. This effect is mitigated in particular also in the case of safety contact strips according to the invention if, at the end face, in the region of this electrical contacting of the conducting layers, this region of the switching chamber is made free of forces by cuts. As a consequence, a deformation of the profile will take place in such a way that a buckling effect occurs in the region of the cut ends, whereby the switching contact is then likewise brought about by touching of the conductive switching layers. In particular, consideration can also be given to making the switching chamber free of forces by cuts in the webs.

Allowance is further made for the high standard of the safety contact strip according to the invention by providing a cap for closing the end face of the safety contact strip. The cap is designed in such a way that, adapted to the profile of the safety contact strip, a shoulder running around annularly in a plane is provided for abutment of the end face of the jacket and of the base of the same. In particular, such an annularly running-around shoulder is suitable for sealed adhesive bonding and/or fusing with the end face of the jacket or of the base. Less consideration is given to adhesive bonding of the end faces of the webs, to continue to permit satisfactory switching. In order to ensure this, it is further provided that the material of the cap has a hardness of less than 65 Shore, in particular of less than 60 Shore, and consequently is significantly softer than the other material chosen. It helps to accomplish this if the material thickness of the cap is kept comparatively small.

In the case of a preferred embodiment, it is provided that lips projecting in front of the shoulder for engagement of the outer jacket. In this respect, it is envisaged in particular that an outer lip covers the abutting edge against the outer jacket of the profile and, if appropriate, is in turn adhesively bonded or fused with the latter. This produces very reliable sealing of the ends at the end faces of the safety contact strip according to the invention. Lips projecting within the profile for an inner engagement of the outer jacket have to make allowance in their formation for the webs of the profile and, if appropriate, be interrupted, and are preferably formed as simple projecting bar-like portions.

For particularly good abutment, in particular also of the outer lip on the outer side of the outer jacket, it is further provided in a refinement of the cap according to the invention that the engagement of the jacket causes it to undergo prestressing, producing particularly good abutment of the outer lip of the cap and of the surface of the jacket.

In a further refinement of the cap according to the invention, it may be provided that at least one sealing lip is provided on the upper side of said cap. This sealing lip is often formed such that it is somewhat smaller than the sealing lip of a safety contact strip. In particular, the sealing lip associated with the cap is arranged within a radius of curvature of the sealing lip of the safety contact strip. As a result of this measure, provided that the sealing lip of the cap attached to a safety contact strip butts against a sealing lip of the safety contact strip, when the sealing lip of the safety contact strip is pressed down this movement is also reliably transferred to the cap. A measure which is useful for the switching performance at the end of a safety contact strip.

The invention is explained in more detail on the basis of the drawing, in which merely exemplary embodiments are represented.

DETAILED DESCRIPTION OF THE PRESENTLY PREFERRED EMBODIMENTS

Figure 1:
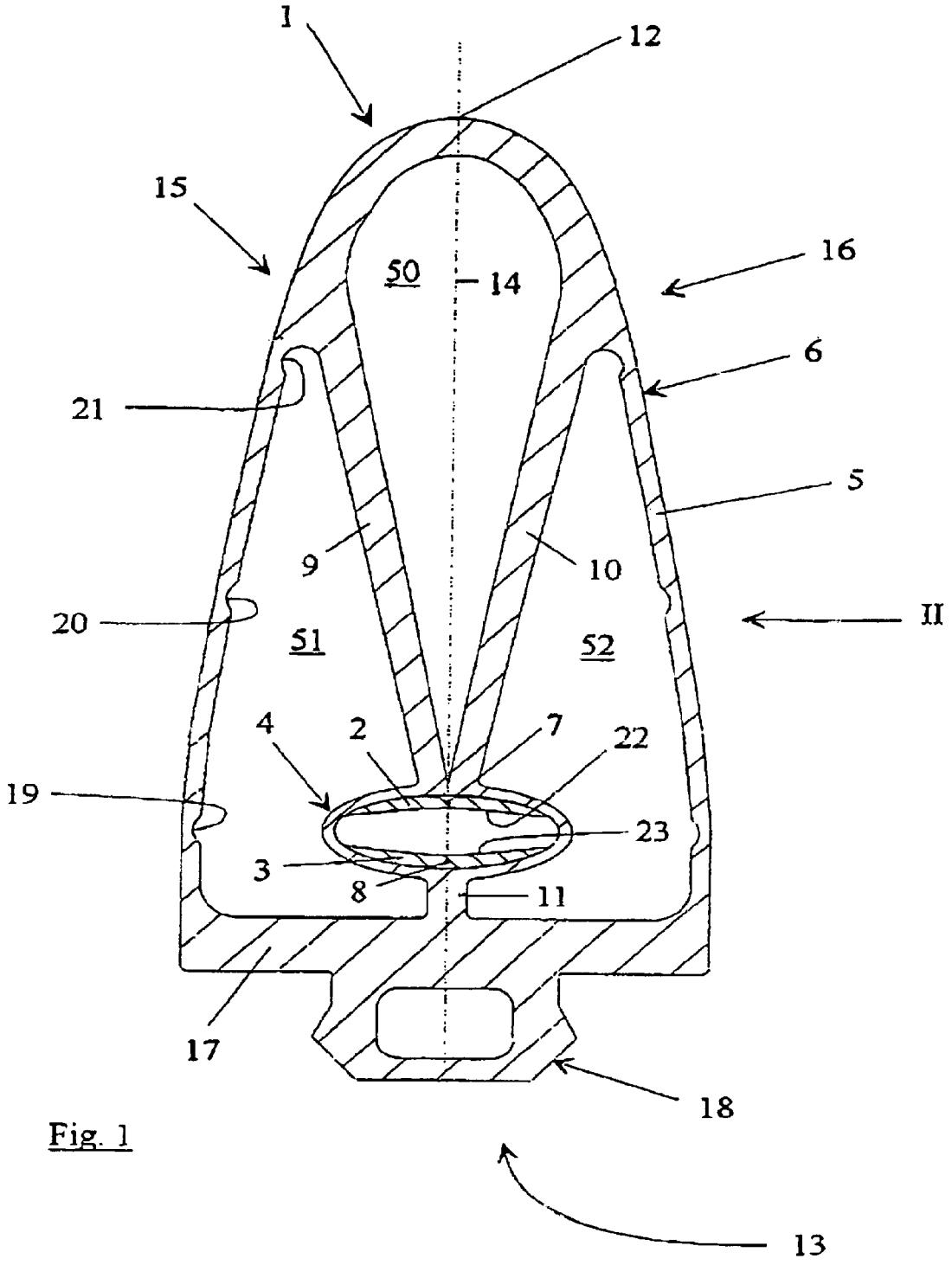
FIG. 1 shows a cross section through a safety contact strip according to the invention.
Figure 2:
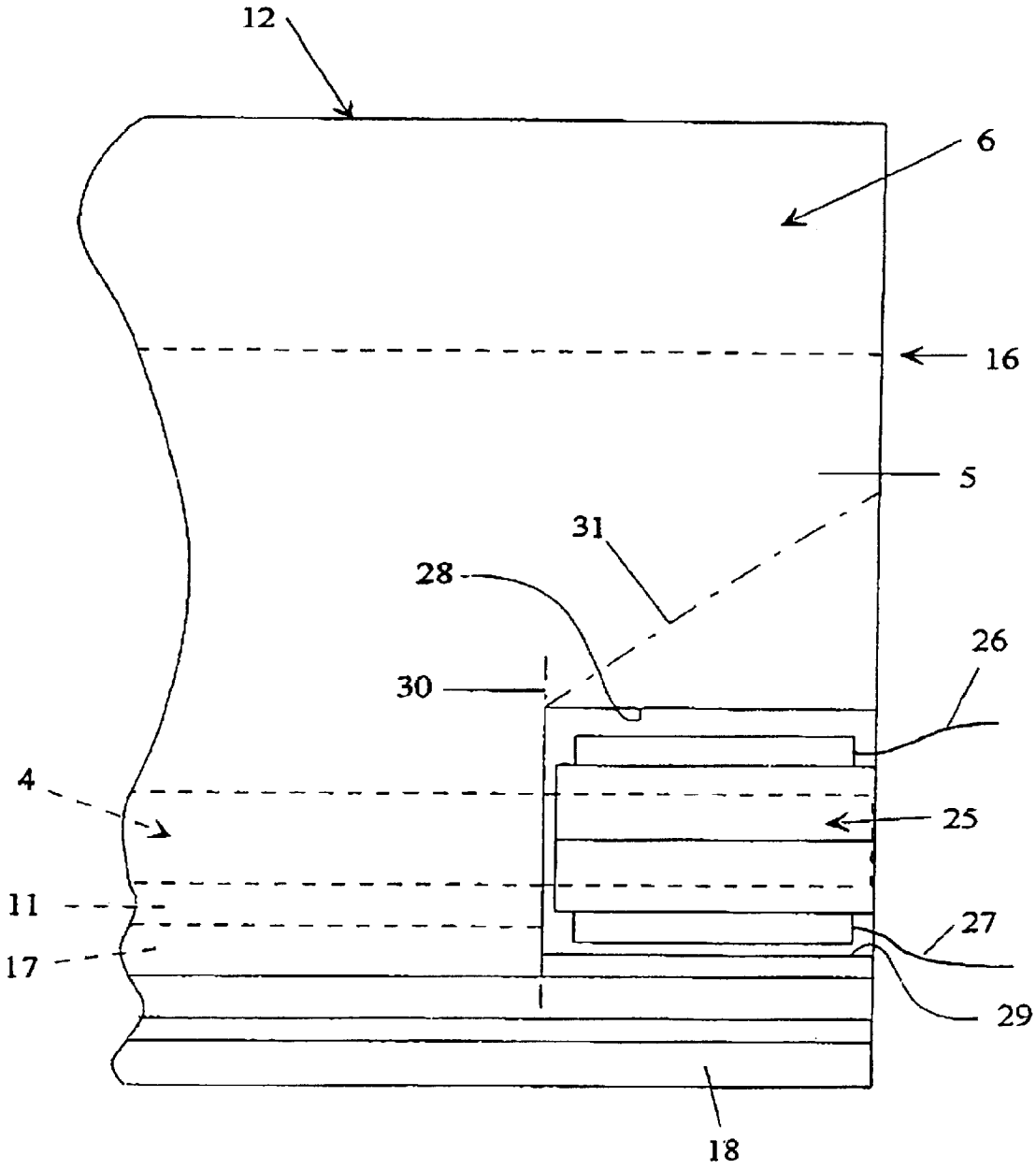
FIG. 2 shows a side view of the profile in the region of an end face according to arrow II in FIG. 1.

The safety contact strip 1 shown in FIGS. 1 and 2 has two conducting switching layers 2, 3 in a closed switching chamber 4, which is arranged within an outer jacket 5 of a profile 6. The profile 6, the switching chamber 4 and the switching layers 2, 3, each with at least one embedded conductor 7, 8, are formed in one piece.

Arranged on the base 17 of the profile 6, on the fastening side 13, there is also a fitting piece 18, for clamping or pushing into a C holding profile, for example an aluminum profile.

In particular, it may be provided that the profile 6 is produced from a thermoplastic elastomer, a TPE material, that the conducting layers 2, 3 consist of an EPDM material, an ethylene/propylene-diene terpolymer, and that the in each case at least one conductor 7, 8 embedded in the conducting layers 2, 3 is a metallic conductor, for example a copper wire, a stranded copper wire, a metal mesh or the like, which materials and conductors form the safety contact strip 1 according to the invention in one piece, preferably in a coextruded manner.

In the course of this measure, it is possible to set the hardness or the rigidity of the TPE profile 6 to a preferred degree, in particular to a Shore hardness of 50 to 70, preferably of 60. By setting the Shore hardness, a balanced ratio between the rigidity and elastic behavior of the profile 6 is achieved.

Alternatively, there is the possibility of producing the outer jacket 5 of the profile 6 and also the conducting switching layers 2, 3 from a single-grade plastic, although the electrical conductivity has to be set appropriately.

According to a further independent feature, it is provided in the case of the safety contact strip 1 according to the invention that, in a cross section according to figure 1, the switching chamber 4 is kept free by webs 9, 10, 11 formed in the manner of spokes. The webs 9, 10, 11 have approximately the same material thicknesses, which are substantially in the range of the material thickness of the profile 6.

Consequently, the outer jacket 5 of the profile 6, the webs 9, 10, 11 within the profile 6 and the switching chamber 4 form a plurality of chambers 50, 51, 52 that are separate from one another integrally within the profile 6.

The outer jacket 5 of the profile 6 has a substantially parabolic cross section, the apex point 12 of which is arranged such that it lies opposite the fastening side according to arrow 13. The apex point 12 lies within a longitudinal center plane 14, which here is also the plane of symmetry for the safety contact strip 1 according to the invention.

Where the webs 9, 10 meet the outer jacket 5, the jacket wall is in each case reinforced to approximately the material thickness of the webs 9, 10, from there up to the apex point 12, so that a further region around the apex point 12 is of a stable form in comparison with the remaining wall of the jacket 5.

This will substantially have the effect that an elastic deformation of the jacket wall 5 occurs in a region between the points of attachment 15, 16 of the webs 9, 10 to the jacket 5 and a base 17, closing the parabolic cross section perpendicularly in relation to the center longitudinal plane 14. To this extent, above the switching chamber 4 there is created a comparatively stable, droplet-like or triangular profile 6, the deformation of which causes the switching chamber 4 to be loaded via the webs 9, 10.

On the underside according to FIG. 1, i.e. on the fastening side 13 of the switching chamber 4, the latter is also kept at a distance from the base 17 of the profile 6 by a single, centrally arranged web 11. As a consequence, the switching chamber 4 can tilt freely and so respond reliably even in the case of switching loads outside the plane of symmetry 14.

Longitudinally running grooves 19, 20, 21, arranged on the jacket wall 5, in particular on the inside, and the associated material weakening of the jacket wall 5 contribute further to the effect that the elastic deformation of the safety contact strip 1 according to the invention takes place in a region between the points of attachment 15, 16 of the webs 9, 10 to the jacket wall 5 and the base 17. In particular in the case of lateral switching loads, there occurs, as it were, a buckling-in or folding-in of the profile. The switching chamber 4 is thereby tilted correspondingly and the force transfer through the webs 9, 10, 11 causes a reliable response of the safety contact strip.

The switching chamber 4, which has accommodated the switching layers 2, 3 in a closed manner and such that they are insulated from the inner space of the profile 6, has a substantially elliptical cross section. The wall thickness of this switching chamber 4 is the smallest in comparison with the other wall thicknesses. Consequently, the switching chamber 4 will elastically deform comparatively easily, it being possible for the deformation also to be set largely by the hardness of the material for the wall of the switching chamber 4.

The longitudinal axis of the switching chamber 4 is perpendicular to the center longitudinal plane 14. Good symmetrical properties, also with regard to the switching performance under switching loads perpendicular to the plane of symmetry, are ensured as a result.

The switching surfaces 22, 23 of the switching layers 2, 3 are of a concave form and the overall cross section of the conducting layers 2, 3 is concave-convex, so that good adaptation or embedment in the elliptical inner cross section of the switching chamber 4 is ensured.

FIG. 2 shows an end-on side view of the safety contact strip I according to the invention as indicated by arrow II in FIG. 1. As already discussed, safety contact strips are preferably prefabricated by the meter as it were, but then still have to be made up by providing electrical connections 25 for the conducting layers. These are, for example, crimp connectors 25, which penetrate the wall of the switching chamber 4 with contact pins and engage in the conducting layers 2, 3 in an electrically conducting manner. The electrical connection to an evaluation unit or the like can then be completed by means of connecting wires 26, 27.

Although the response of the safety contact strip I is often disturbed in the region of such contacting 25, the full length of the profile 6 can nevertheless be used, i.e. a length which substantially corresponds to the length of the switching chamber 4 including the contacting 25, if the region of the electrical contacting 25 is cut free in terms of forces by cuts 28, 29. The height and depth of the cuts 28, 29 are to be dimensioned here in such a way that, when the profile 6 undergoes deformation at the end, it experiences a buckling movement in the region of the depth of the cuts, indicated by the dash-dotted line 30, so that the switching chamber 4 with conducting layers 2, 3 that are operational there, offset as it were over the longitudinal axis of the profile, carries out the switching operation.

In this respect, the geometry of the cuts 28, 29 is of rather secondary importance and, for example, the deformation path for the profile 6 can be increased by a wedge-shaped cut, indicated by the dash-dotted line 31. Even in such a case, the profile 6 completely covers the contacting 25.

The switching chamber 4 can also be freed in terms of forces by cuts in the webs 9, 10, 11.

Figure 3:
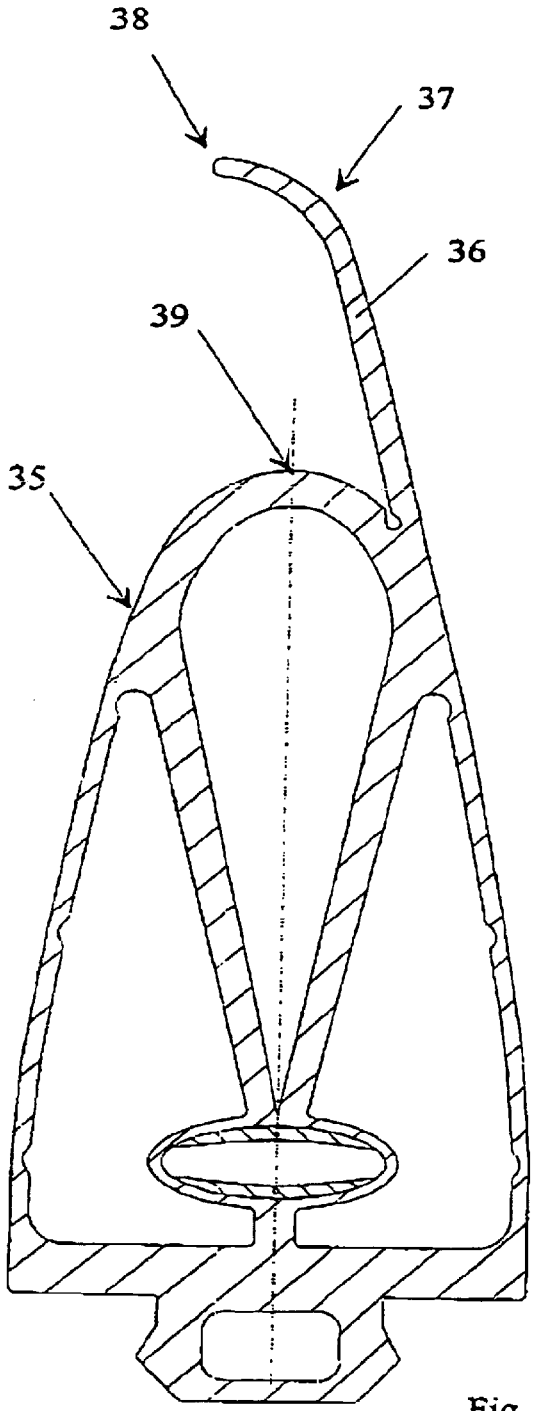
FIG. 3 shows a second exemplary embodiment.

Shown in FIG. 3 is a second exemplary embodiment of a profile 35, that is also formed in particular as a coextrudate and to the greatest extent corresponds to the profile of the first exemplary embodiment. Attached to the profile 35 is a sealing lip 36. The sealing lip 36 consists of the same material as the profile 35, in particular a TPE material. The sealing lip 36 is attached tangentially to the profile 35 and is consequently connected very securely to the latter. In the cross section shown in FIG. 3, the sealing lip 36 also has a bend 37, by which bend 37, and the free end 38 of the sealing lip 36, the apex point 39 of the profile 35 is covered.

Figure 4:
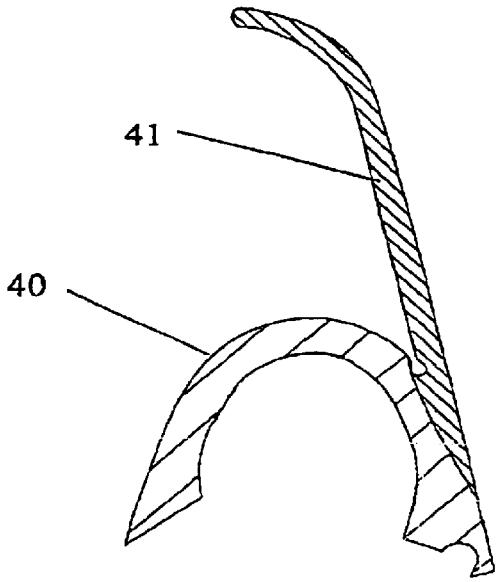
FIG. 4 shows a variant of the attachment of a sealing lip.

If a TPE material is used for a profile with a sealing lip, it is sensitive with regard to freezing wetness on account of its comparatively open-cell surface structure. It may therefore be envisaged to produce the sealing lip 41 according to FIG. 4 from a material which is, in particular, smooth on the surface and permanently elastic. In FIG. 4, the sealing lip 41 consisting of a different material is attached to the profile 40, although it is preferred for the safety contact strip to continue to be produced in one piece as a coextrudate. In the case of the exemplary embodiment, the safety contact strip according to the invention is then obtained in one piece in a coextruded form from four different materials, to be specific the material of the profile jacket 40, of the sealing lip 41, of the conducting switching layers and of the metallic conductors embedded therein.

Figure 5:
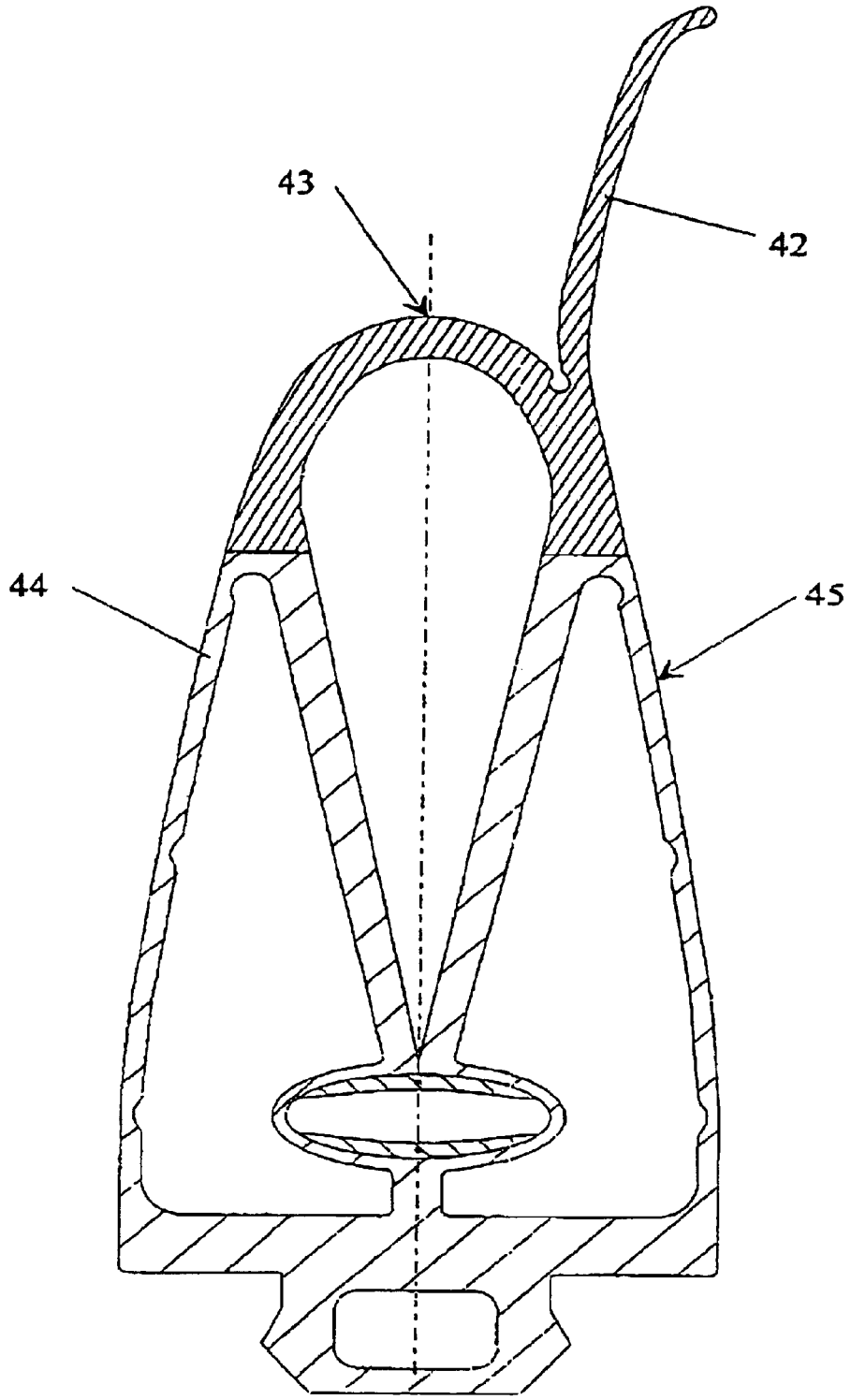
FIG. 5 shows a second exemplary embodiment.

In the exemplary embodiment according to FIG. 5, it is further shown that, apart from the sealing lip 42, a portion around the apex point 43 may also consist in particular of a material which is smooth on the surface and elastic. In the case of the exemplary embodiment according to FIG. 5, too, the safety contact strip there is preferably produced as a coextrudate.

As an alternative or in addition to replacement of a portion of the jacket 45 of the profile 44, it may also be provided that the profile 45 has, merely in the manner of a surface coating, a material which, in particular, is smooth on the surface and elastic, and in particular of a single-grade plastic.

Figure 6:
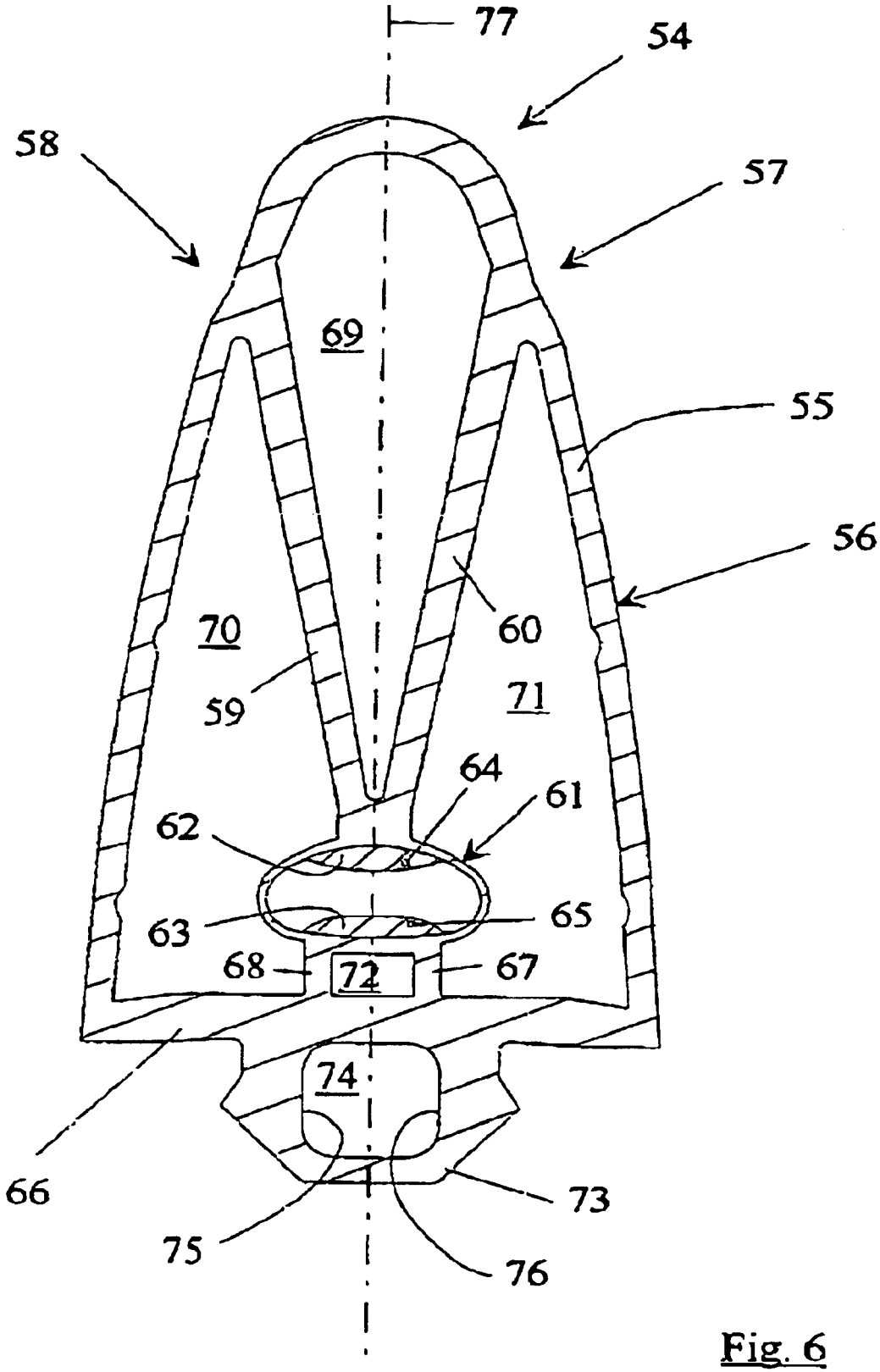
FIG. 6 shows a cross section through a further exemplary embodiment.

FIG. 6 shows a further exemplary embodiment of a safety contact strip 54 according to the invention without a sealing lip. The outer jacket 55 of the profile 56 has in turn a substantially parabolic cross section, symmetrical in relation to a center plane 77. In the regions 57, 58 of the attachments, at which webs 59, 60 are connected on the inner side of the jacket, the profile 56 is set back slightly toward the center plane 77.

The webs 59, 60 are connected at the other end to a switching chamber 61, which is again provided on the inside with two conducting layers 62, 63. A metallic conductor 64, 65 is respectively recessed into these conducting layers 62, 63 unsymmetrically in relation to the center plane 57. The conductors 64, 65 may be arranged outstretched in the conducting layers 62, 63 or meandering, for better contact.

Above a base 66, the switching chamber 61 is further held by two webs 67, 68. The outer jacket 55, the webs 59, 60, 67, 68 together with the switching chamber 61 have the effect of forming chambers 69 to 72 that are separate from one another.

Connected on the underside of the base 66 there is in turn a fitting piece 73 for clamping or pushing into, in particular, a C holding profile. The fitting piece 73 is formed such that it encloses a hollow space 74. The vertically rising side walls 75, 76 of said hollow space are in line with the exterior walls of the webs 67, 68.

The base 66 is formed such that it falls away, at least in certain portions, from the center longitudinal plane 57, i.e. toward the C holding profile, so that clamping the fitting piece 73 into the C holding profile achieves the effect that the safety contact strip 54 rests in place under a prestress.

Figure 7:
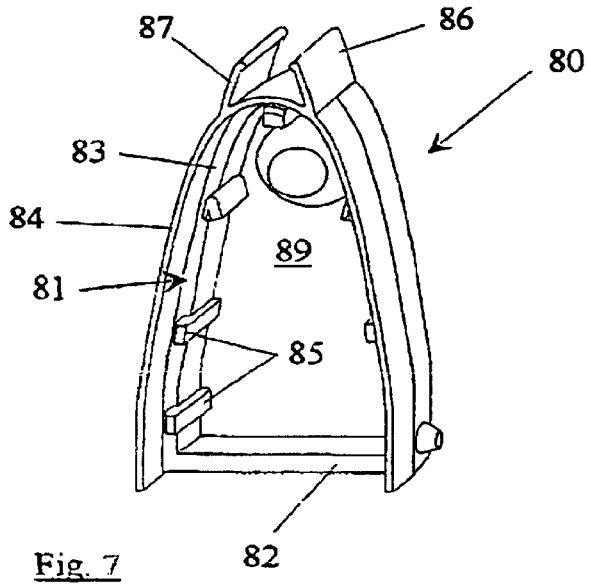
FIG. 7 shows in an isometric representation a cap closing the end face of a safety contact strip according to the invention.
Figure 8:
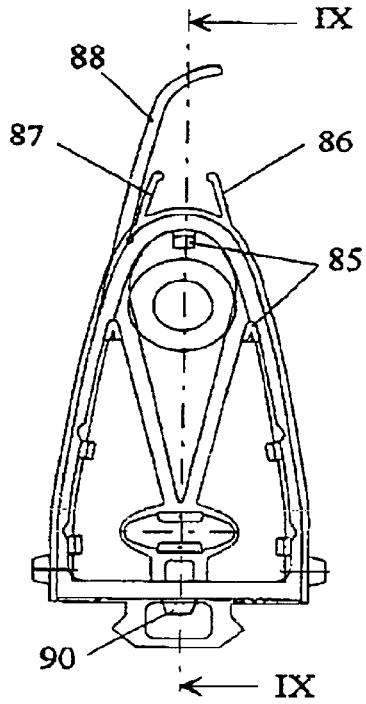
FIG. 8 shows in an end-on view the cap according to FIG. 7 with an indicated profile.
Figure 9:
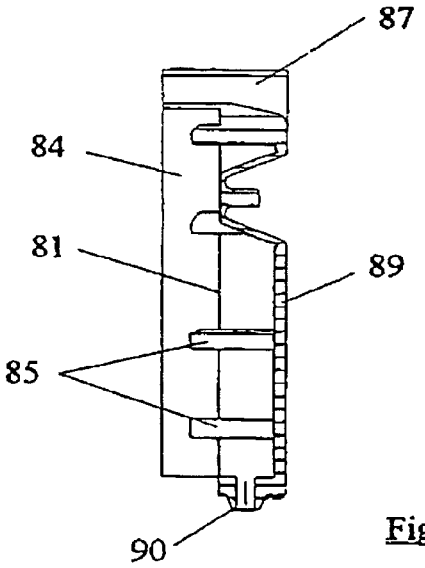
FIG. 9 shows a cross section through the cap according to the line IX, IX in FIG. 8.

A cap 80 for closing a safety contact strip according to the invention at the end face is further explained on the basis of FIGS. 7 to 9. The cap 80 has an annularly running-around shoulder 81, which is arranged in a plane which is in front of the cap base 89 toward the inside. Connection to the base of a safety contact strip takes place with a portion 82 and connection to the end face of the outer jacket of a safety contact strip takes place with a portion 83. In front of the shoulder 81 there is an outer lip 84 for covering the abutting edge between an outer jacket and the shoulder 81. This lip 84 is intended to cover only the outer jacket, so that this cap 80 can also be fitted unproblematically onto a C holding profile.

The cap 80 will then have, in a way which is customary per se, with a grommet 90, for leading through connecting cables. Which, protected in this way within the C holding profile, can be led to an evaluation circuit or the like.

Adhesively bonded or fused to the outer jacket and the base of a safety contact strip in the region of the shoulder 81 and on the inside of the lip 84, a sealed termination of the safety contact strip according to the invention is ensured.

On the inside of the profile, further lips 85 project in front of the shoulder 81. By designing these lips 85 in the form of merely bar-like portions, allowance is made for the webs lying within the profile, cf. FIG. 8.

Between the lip 84 and the lip portions 85, the outer jacket of a safety contact strip is engaged in such a way that a prestressing takes place in the jacket on account of this engagement, and reliable abutment of the Up 84, and consequently sealing coverage of the joint, is ensured.

On the upper side, the cap 80 also has two sealing lips 86, 87. These sealing lips 86,87 are significantly shortened in comparison with the sealing lips 88 on a safety contact strip, also compare FIG. 8. Since, however, in the case of the exemplary embodiment shown, the sealing lips 87, 88 also overlap in their longitudinal extent of the safety contact strip to the extent to which the lip 84 projects, when the sealing lip 88 is pressed down there is also a good force transfer to the cap, and consequently the switching performance of the safety contact strip in the end region of the same is further improved.

Contributing further to an improved switching performance specifically in the end region of a safety contact strip is the measure of providing a material for the cap of a hardness of less than 65 Shore, in particular of less than about 60 Shore. The wall thicknesses of this cap 80 are also kept comparatively small.

If a plug contact which closes the switching chamber of the safety contact strip according to the invention is also provided, an extremely high degree of sealing from environmental influences is obtained at the end face. If the safety contact strip, the cap and the plug contact are also produced from a single-grade plastic, disposal continues to be unproblematical.

What is claimed is:

1. A safety contact strip comprising a profile forming an outer jacket, said profile having a base forming a fastening side, a non-conducting closed switching chamber within said profile and connected to said profile by webs, said webs including at least one web connected to said base and a pair of webs arranged to form a V-shape opposite from said fastening side of said profile, and at least two conducting switching layers in said switching chamber, each said switching layer having at least one embedded conductor, wherein said profile, said switching chamber, and said switching layers are formed in one piece.

2. A safety contact strip as in claim 1 wherein said safety contact strip is a coextrudate.

3. A safety contact strip as in claim 1 wherein said profile is formed from TPE, said switching layers are formed from EPDM, and said conductors are formed of metal.

4. A safety contact strip as in claim 1 wherein said profile and said switching layers are formed from a single grade of plastic and said conductors are formed of metal.

5. A safety contact strip as in claim 1 wherein said profile is at least partially covered with a surface coating.

6. A safety contact strip as in 1 wherein said outer jacket comprises an elastomeric material.

7. A safety contact strip as in claim 1 wherein said contact strip is formed with a symmetric cross-section in relation to a longitudinal central plane.

8. A safety contact strip as in claim 1 wherein said outer jacket has a parabolic cross-section with an apex opposite from said fastening side.

9. A safety contact strip as in claim 1 wherein said profile comprises a sealing lip extending tangentially from said outer jacket, said sealing lip having a free end with a bend.

10. A safety contact strip as in claim 1 wherein said jacket has an inner side formed with longitudinally running grooves.

11. A safety contact strip as in claim 1 wherein said switching chamber has an elliptical cross-section.

12. A safety contact strip as in claim 1 wherein said safety contact strip has a longitudinal center plane, said switching chamber having a longitudinal axis which is perpendicular to said longitudinal center plane.

13. A safety contact strip as in claim 1 wherein said conducting switching layers each have a concave surface.

14. A safety contact strip as claimed in claim 1, wherein said outer jacket, said webs, and said switching chamber form a plurality of chambers that are separate from one another within the profile.

15. A safety contact strip as in claim 14 wherein said conducting switching layers are arranged above and below said longitudinal axis.

* * * * *

UNITED STATES PATENT AND TRADEMARK OFFICE

CERTIFICATE OF CORRECTION

PATENT NO. : 6,740,826 B1
DATED : May 25, 2004
INVENTOR(S) : Helmut Friedrich

It is certified that error appears in the above-identified patent and that said Letters Patent is hereby corrected as shown below:

Title page,
Item [73], Assignee, should read:
-- ASO GmbH Antriebs -und Steuerungstechnik, Salzkotten (DE) --

Signed and Sealed this

Twenty-first Day of December, 2004

JON W. DUDAS
*Director of the United States Patent and Trademark Office*